US006814603B2

(12) United States Patent
Okita et al.

(10) Patent No.: US 6,814,603 B2
(45) Date of Patent: Nov. 9, 2004

(54) ELECTRICAL CONNECTOR FOR ELECTRONIC PACKAGE

(75) Inventors: Masao Okita, Furukawa (JP); Yao-Chi Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 26 days.

(21) Appl. No.: 10/299,329

(22) Filed: Nov. 18, 2002

(65) Prior Publication Data

US 2004/0002247 A1 Jan. 1, 2004

(30) Foreign Application Priority Data

Jun. 28, 2002 (TW) ..... 91209761 U

(51) Int. Cl.[7] ..... H01R 4/50; H01R 13/625
(52) U.S. Cl. ..... 439/342
(58) Field of Search ..... 439/342, 259–270

(56) References Cited

U.S. PATENT DOCUMENTS 6,254,415 B1 * 7/2001 Mizumura et al. ..... 439/342
6,676,431 B2 * 1/2004 Kukita et al. ..... 439/342
2003/0186578 A1 * 10/2003 McClinton ..... 439/342

* cited by examiner

*Primary Examiner*—Javaid H. Nasri
(74) *Attorney, Agent, or Firm*—Wei Te Chung

(57) ABSTRACT

An electrical connector (1) for electrically connecting a central processing unit (CPU) with a printed circuit board (PCB). The connector includes a base (10), a cover (12), terminals (19) received in the base, a columnar cam actuator (16) for actuating the cover to slide along the base, a protecting mechanism, and a base ring (18). The protecting mechanism includes a base plate (142) secured in the base, and a cover plate (141) secured in the cover. The base plate includes a base portion (1424) and a raised portion (1427). The base and raised portions cooperatively define a fastening space (1423) therebetween. In assembly of the connector, the cam actuator is passed through the cover, the cover plate and the base plate, and a bottommost column of the cam actuator is received in the fastening space. The base ring is inserted into the fastening space and riveted to the bottommost column.

21 Claims, 5 Drawing Sheets

ELECTRICAL CONNECTOR FOR ELECTRONIC PACKAGE

BACKGROUND OF THE INVENTION

1. Field of the Invention

The present invention relates to an electrical connector for electrically connecting an electronic package such as a central processing unit (CPU) with a circuit substrate such as a printed circuit board (PCB), and particularly to an electrical connector having a cam actuator with reduced assembly tolerance and enhanced strength.

2. Description of Related Art

An integrated circuit (IC) package having a multiplicity of pins depending from a bottom surface thereof and arranged in a grid array is known as a pin grid array (PGA) package. Connectors for electrically connecting PGA packages with PCBs are known as PGA sockets.

A PGA socket comprises a base having a multiplicity of terminals arranged in a grid array corresponding to the lead pins of the PGA package, a cover defining a multiplicity of through holes arranged in a grid array corresponding to the lead pins of the PGA package, and a cam actuator for actuating the cover to slide along the base. The PGA package is mounted on the cover, with the lead pins received in the through holes. When the cover is slid, the lead pins mate with the terminals.

A conventional electrical connector for high-density pins is disclosed in "High-density PGA Socket System" (April 2000, Electronic Engineering). Such socket connector generally adopts a cam actuator for actuating a cover of the socket to slide along a base of the socket. Typical cam actuator structures are disclosed in U.S. Pat. Nos. 6,250,941, 6,254,415, 6,280,224, 6,296,507, and 6,338,640.

Referring to FIG. 6, a conventional electrical connector 5 disclosed in U.S. Pat. No. 6,338,640 comprises a generally rectangular insulative base 50, a cover 52 slidably attached on the base 50, a multiplicity of conductive terminals 58 received in the base 50, a cam actuator 56 for actuating the cover 52 to slide along the base 50, a protecting mechanism and a base ring 59. The protecting mechanism comprises a base plate 542 secured in the base 50, and a cover plate 541 secured in the cover 52. The cam actuator 56 comprises several short, round columns one on top of the other. Circumferences of the columns sequentially decrease from top to bottom of the cam actuator 56. Central axes of the columns are offset from each other. A topmost column outwardly forms a protrusion in a radial direction.

Referring also to FIG. 7, in assembling the electrical connector 5, the columns of the cam actuator 56 are sequentially passed through the cover 52, the cover plate 541, the base plate 542 and the base 50. The base 50 and the cam actuator 56 cooperatively define a fastening space 501 therebetween. A bottommost column of the cam actuator 56 is disposed in the fastening space 501. The base ring 59 is inserted into the fastening space 501 and riveted to the bottommost column of the cam actuator 56. Thus the base 50, the cover 52, the cam actuator 56 and the protecting mechanism are assembled together.

The overall assembly tolerance of the cam actuator 56 received in the base 50 comprises the manufacturing tolerance of the base plate 542, the manufacturing tolerance of the base 50 and the assembly tolerance between the base plate 542 and the base 50. Thus the overall assembly tolerance of the cam actuator 56 is unduly large.

The unduly large overall assembly tolerance of the cam actuator 56 results in unduly large interspaces existing in the assembled electrical connector 5. The assembled electrical connector 5 is liable to be unstable. In particular, the cam actuator 56 is prone to tilt, and excessively large force may be required to operate the cam actuator 56. Furthermore, the fastening space 501 is relatively small. Accordingly, the bottommost column of the cam actuator 56 received in the fastening space 501 is relatively short. This limits an amount of fastening force that can be applied on the bottommost column when the base ring 59 is riveted thereto. Moreover, the base ring 59 is liable to contact the nearby PCB.

In view of the above, a new electrical connector that overcomes the above-mentioned disadvantages is desired.

SUMMARY OF THE INVENTION

Accordingly, an object of the present invention is to provide an electrical connector for electrically connecting a CPU with a PCB, whereby the electrical connector has a cam actuator with reduced assembly tolerance and enhanced stability.

Another object of the present invention is to provide an electrical connector for electrically connecting a CPU with a PCB, whereby the electrical connector has a cam actuator with enhanced strength.

To achieve the above-mentioned object, an electrical connector in accordance with a preferred embodiment of the present invention is for electrically connecting a CPU with a PCB. The connector comprises a generally rectangular insulative base, a cover slidably attached on the base, a multiplicity of conductive terminals received in the base, a columnar cam actuator for actuating the cover to slide along the base, a protecting mechanism, and a base ring. The protecting mechanism comprises a base plate secured in the base, and a cover plate secured in the cover. The base plate comprises a base portion, and a raised portion upwardly formed from a middle of the base portion. The base portion and the raised portion cooperatively define a fastening space therebetween. In assembly of the connector, the cam actuator is sequentially passed through the cover, the cover plate and the base plate, and a bottommost column of the cam actuator is thus received in the fastening space. The base ring is inserted into the fastening space and riveted to the bottommost column of the cam actuator. Thus the base, the cover, the cam actuator and the protecting mechanism are assembled together. The overall assembly tolerance of the cam actuator received in the base is merely the manufacturing tolerance of the base plate. The bottommost column of the cam actuator can be relatively long. This enables a relatively large fastening force to be applied to said column when the base ring is riveted thereto.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
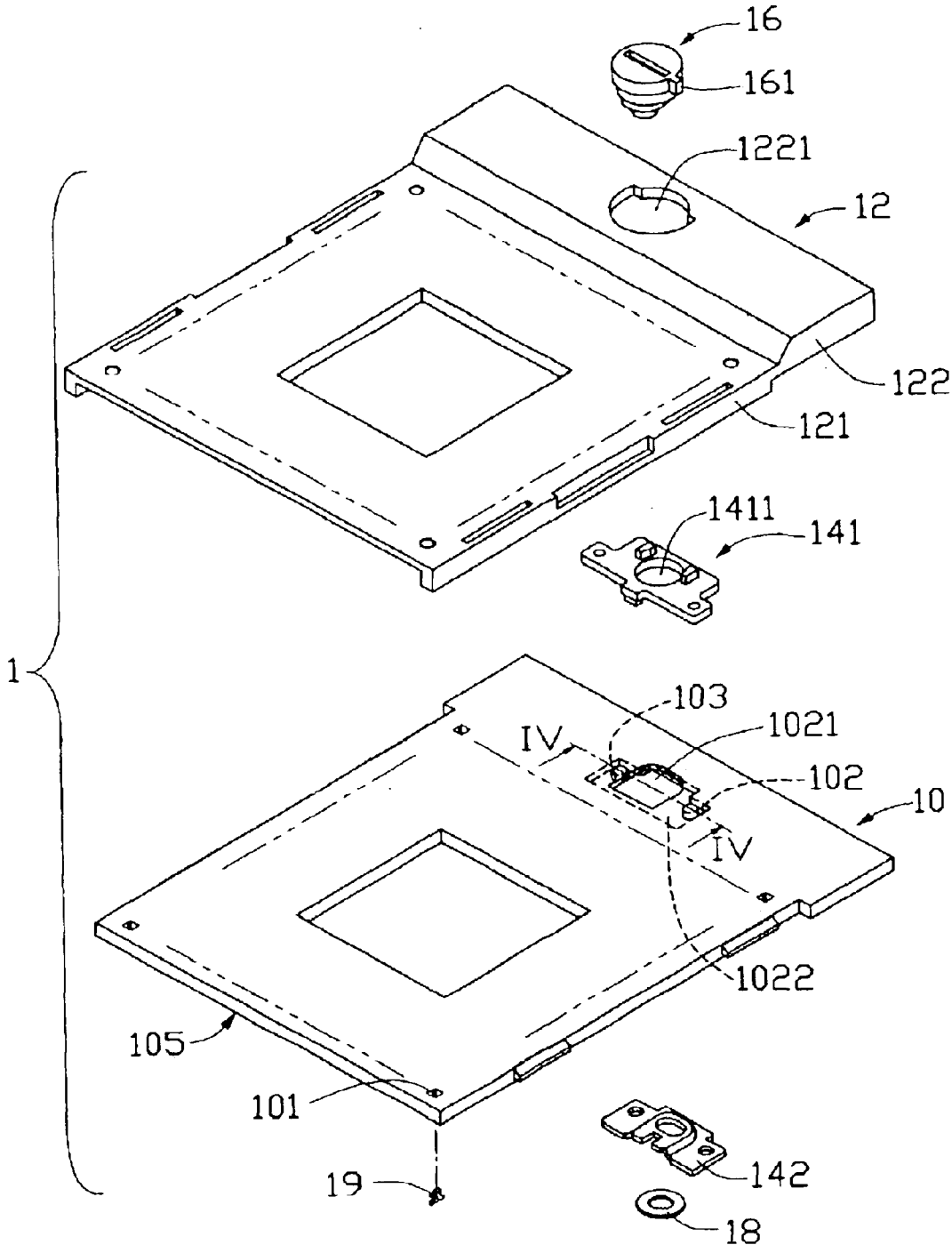
FIG. 1 is an exploded, simplified isometric view of an electrical connector in accordance with a preferred embodiment of the present invention.
Figure 4:
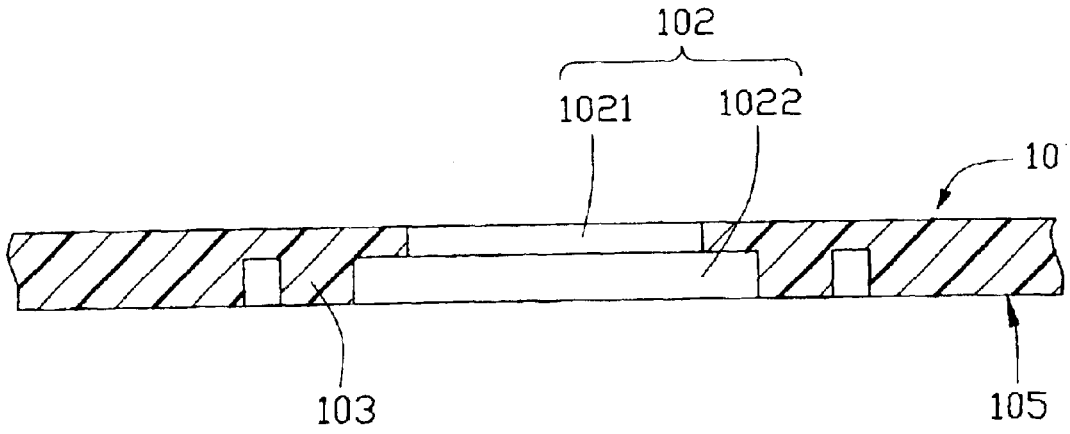
FIG. 4 is a cross-sectional view taken along line IV—IV of FIG. 1.

Referring to FIGS. 1 and 4, an electrical connector 1 in accordance with a preferred embodiment of the present invention for electrically connecting a central processing unit (CPU) with a printed circuit board (PCB) comprises a generally rectangular insulative base 10, a cover 12 slidably attached on the base 10, a multiplicity of conductive terminals 19 received in the base 10, a cam actuator 16 for actuating the cover 12 to slide along the base 10, a protecting mechanism, and a base ring 18.

The cam actuator 16 comprises several short, round columns one on top of the other. Circumferences of the columns sequentially decrease from top to bottom of the cam actuator 16. Central axes of the columns are offset from each other. A topmost column outwardly forms a protrusion 161 in a radial direction.

The cover 12 comprises a main housing 121, and a ledge 122 defined at one end of the housing 121. A top hole 1221 is defined in a middle of the ledge 122. The top hole 1221 comprises two generally semicircular portions having different diameters from each other. A recess (not shown) is defined in a bottom of the cover 12 facing to the base 10, corresponding to the top hole 1221.

The base 10 comprises a bottom joining surface 105 for joining to the PCB. A multiplicity of passageways 101 is vertically defined through the base 10 to the joining surface 105. The passageways 101 are arranged in a rectangular array, and receive the corresponding terminals 19. A step-like recess 102 is defined through a middle of an end portion of the base 10, corresponding to the top hole 1221. The step-like recess 102 comprises a lower T-shaped receiving portion 1022 having a large cross-sectional area, and an upper U-shaped fastening portion 1021 having a small cross-sectional area. A pair of position columns 103 is formed in the base 10 on opposite sides of the receiving portion 1022 respectively. The position columns 103 extend to the joining surface 105.

Figure 2:
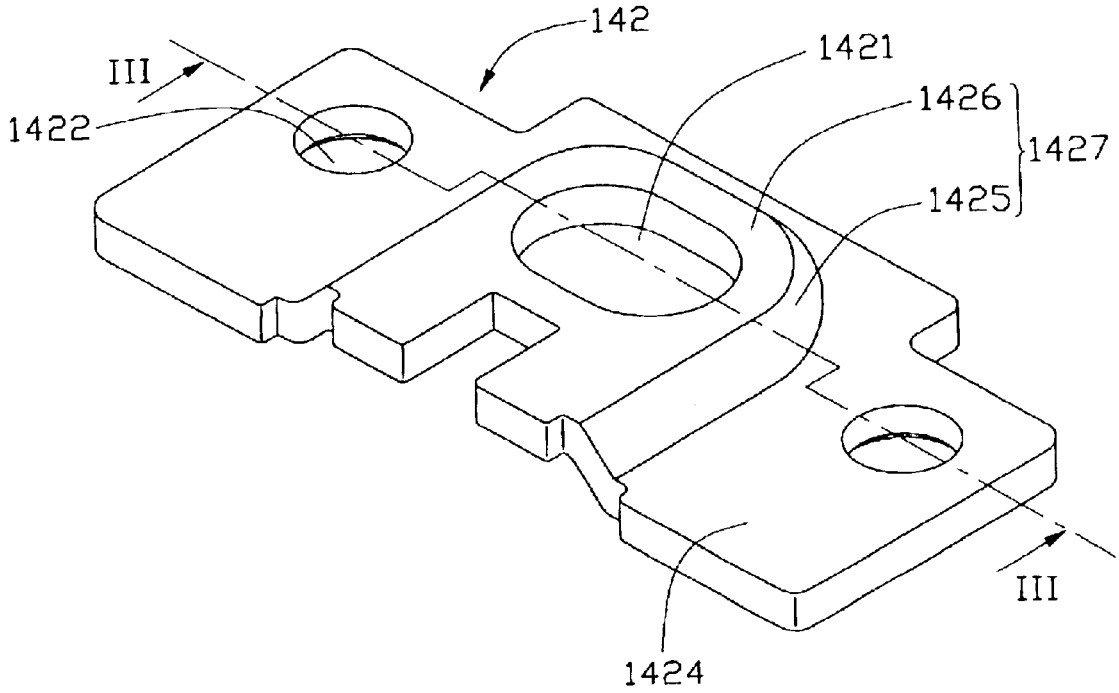
FIG. 2 is an enlarged view of a base plate of the connector of FIG. 1.
Figure 3:
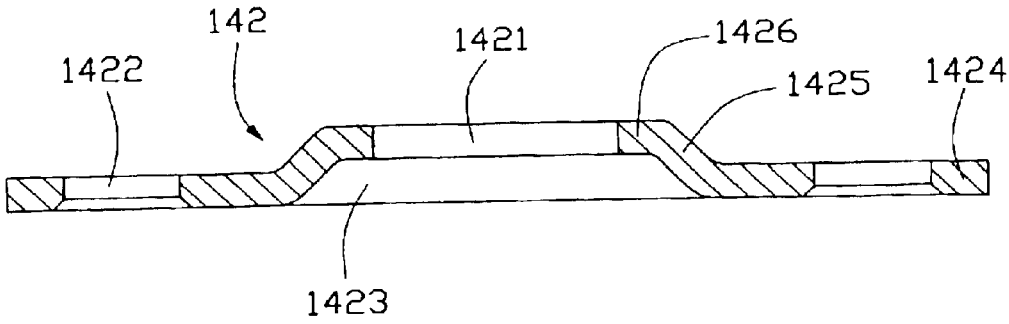
FIG. 3 is a cross-sectional view taken along line III—III of FIG. 2.
Figure 5:
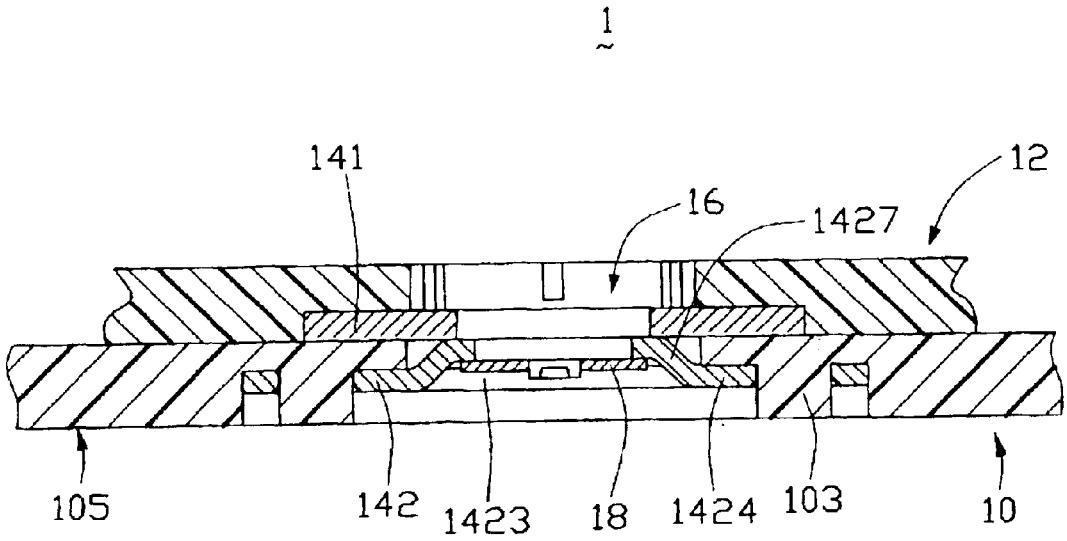
FIG. 5 is a partly cross-sectional view of part of the connector of FIG. 1 when the connector is fully assembled.
Figure 6:
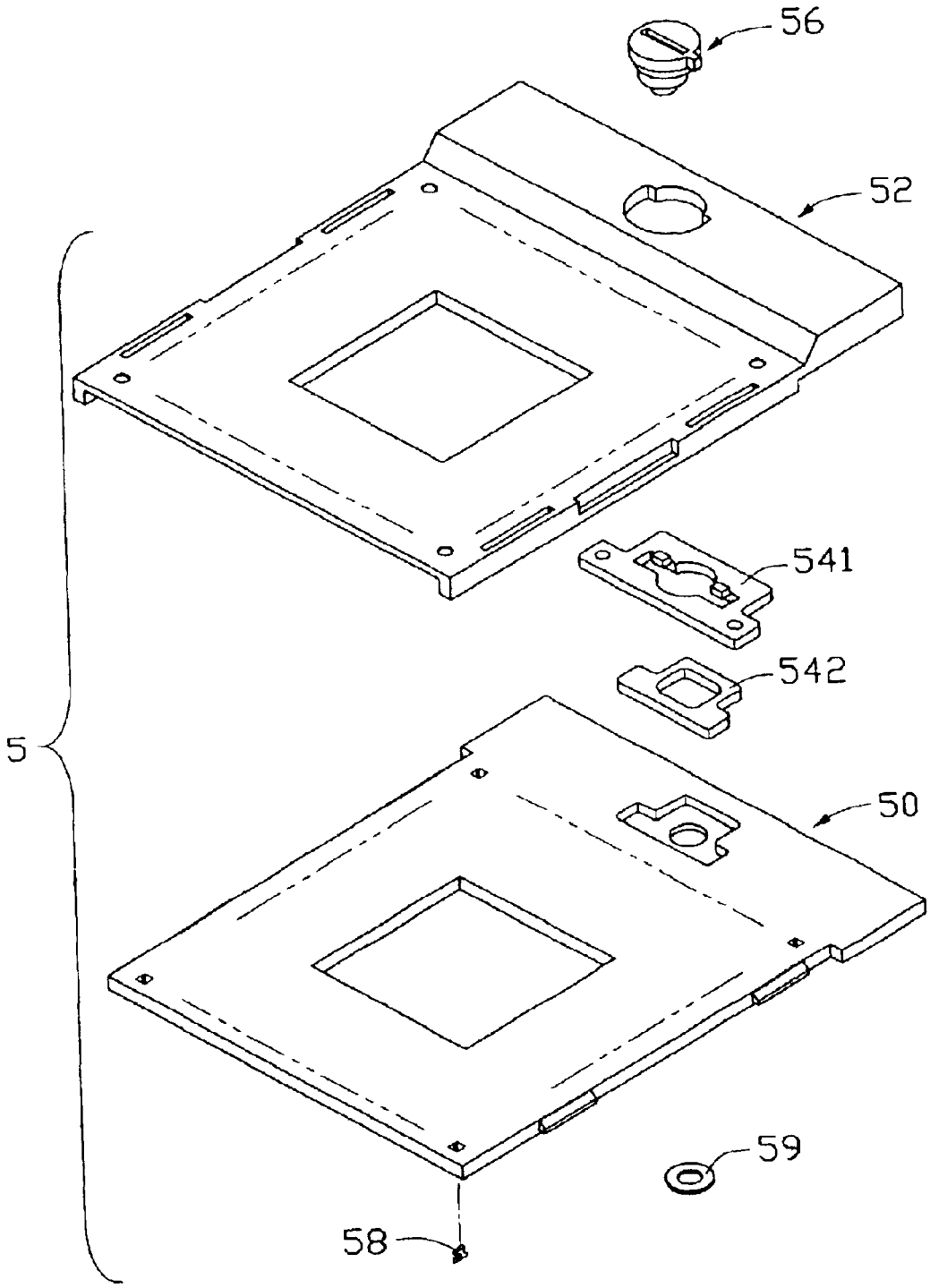
FIG. 6 (PRIOR ART)
FIG. 6 is an exploded, simplified isometric view of a conventional electrical connector.
Figure 7:
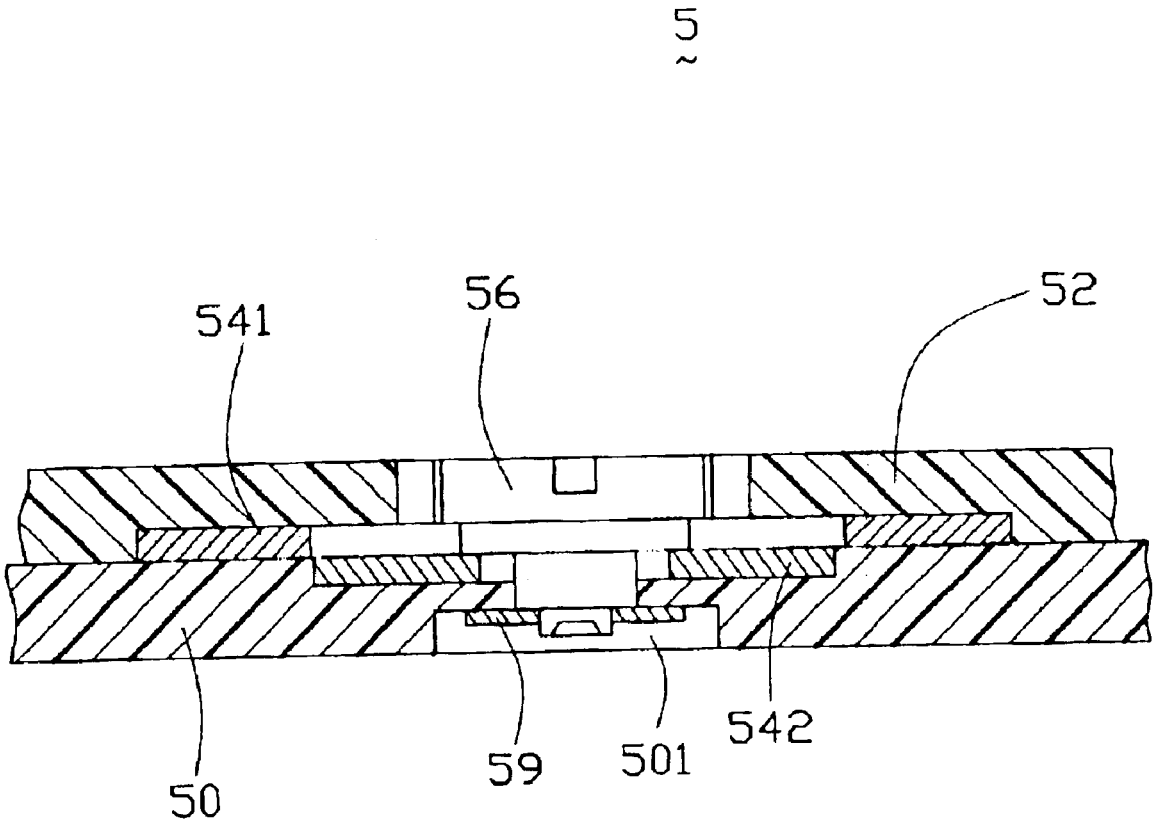
FIG. 7 (PRIOR ART)
FIG. 7 is a partly cross-sectional view of part of the connector of FIG. 6 when the connector is fully assembled.

Referring also to FIGS. 2, 3, and 5, the protecting mechanism comprises a base plate 142 secured in the base 10 and a cover plate 141 secured in the cover 12. The cover plate 141 and the base plate 142 are each made of metallic material. The cover plate 141 is insert molded in the recess (not shown) of the cover 12, and defines a circular through hole 1411 in a middle thereof (see FIG. 1). The base plate 142 comprises a base portion 1424, and a raised portion 1427 upwardly formed from a middle of the base portion 1424.

The base plate 142 defines a pair of position holes 1422 on opposite sides of the base portion 1424 respectively. Each position hole 1422 is flared at a bottommost portion thereof. The base portion 1424 of the base plate 142 is slightly shorter than a corresponding length of the receiving portion 1022 of the step-like recess 102 of the base 10.

The raised portion 1427 comprises a flat top portion 1426 and a slanted transitional portion 1425. The top portion 1426 is parallel -to the base portion 1424, and the transitional portion 1425 interconnects the base portion 1424 with the top portion 1426. A through hole 1421 is defined in a middle of the top portion 1426, corresponding to the top hole 1221 of the cover 12.

The base portion 1424 and the raised portion 1427 cooperatively define a fastening space 1423 therebetween. The fastening space 1423 is below and in communication with the through hole 1421. It is clearly shown in FIGS. 2, 3 and 5 that the base portion 1424 and the raised portion 1427 have a common thickness.

In assembly of the electrical connector 1, the base plate 142 is passed upwardly from the joining surface 105 to be received in the step-like recess 102 of the base 10. The position columns 103 of the base 10 are received in the position holes 1422 of the base plate 142, and correctly position the base plate 142. The raised portion 1427 of the base plate 142 is completely received in the fastening portion 1021 of the step-like recess 102, and the base portion 1424 of the base plate 142 is fittingly received in the receiving portion 1022 of the step-like recess 102.

The cover 12 is placed on the base 10. The columns of the cam actuator 16 are sequentially passed through the top hole 1221 of the cover 12, the through hole 1411 of the cover plate 141 and the through hole 1421 of the top portion 1426 of the base plate 142. A bottommost column of the cam actuator 16 is thus received in the fastening space 1423. The base ring 18 is inserted into the fastening space 1423 and riveted to the bottommost column of the cam actuator 16. Thus the base 10, the cover 12, the cam actuator 16 and the protecting mechanism are assembled together.

The overall assembly tolerance of the cam actuator 16 received in the base 10 is the manufacturing tolerance of the base plate 142. The overall assembly tolerance excludes the manufacturing tolerance of the base 10 and the assembly tolerance between the base plate 142 and the base 10. This minimizes sizes of interspaces in the assembled electrical connector 1. This accordingly enhances precision of assembly of the electrical connector 1, stability of the assembled electrical connector 1, and smooth and easy operation of the cam actuator 56.

Furthermore, the fastening space 1423 is relatively large. Accordingly, the bottommost column of the cam actuator 16 received in the fastening space 1423 can be relatively long. This enables a relatively large fastening force to be applied to said column when the base ring 18 is riveted thereto. Furthermore, the base ring 18 is effectively prevented from contacting the PCB.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, the electrical connector comprising:

an insulative base defining a step-like recess therethrough;

a cover slidably attached on the base;

a plurality of conductive terminals received in the base;

a columnar cam actuator; and a protecting mechanism comprising a base plate received in the step-like recess of the base and a cover plate secured in the cover, wherein the base plate comprises a base portion and a raised portion, and the base portion and the raised portion cooperatively define a fastening space therebetween for receiving of a bottom end of the cam actuator therein.

2. The electrical connector as claimed in claim 1, wherein the cam actuator comprises a plurality of columns one on top of the other, with circumferences of the columns being different and central axes of the columns being offset from each other.

3. The electrical connector as claimed in claim 1, wherein the cover comprises a main housing and a ledge defined at one end of the housing, and a top hole is defined in the ledge and comprises two generally semicircular portions having different diameters from each other.

4. The electrical connector as claimed in claim 1, wherein the raised portion is integrally connected with the base portion.

5. The electrical connector as claimed in claim 1, wherein the step-like recess comprises a lower receiving portion and an upper fastening portion, and the lower receiving portion has a cross-sectional area larger than a cross-sectional area of the upper fastening portion.

6. The electrical connector as claimed in claim 5, wherein the base portion of the base plate is slightly shorter than a corresponding length of the receiving portion of the step-like recess.

7. The electrical connector as claimed in claim 5, wherein the raised portion of the base plate is completely received in the fastening portion of the step-like recess, and the base portion of the base plate is fittingly received in the receiving portion of the step-like recess.

8. The electrical connector as claimed in claim 5, wherein a pair of position columns is formed in the base on opposite sides of the receiving portion.

9. The electrical connector as claimed in claim 8, wherein a pair of position holes is defined in opposite sides of the base portion of the base plate, and the position holes receive the position columns of the base.

10. The electrical connector as claimed in claim 1, wherein the cover plate is insert molded in the recess of the cover, and the cover plate defines a through hole receiving the cam actuator therethrough.

11. The electrical connector as claimed in claim 4, wherein the raised portion vertically offsets from the base portion to define the fastening space, and the raised portion and the base portion have a substantially common thickness.

12. An electrical connector for electrically connecting an electronic package with a circuit substrate, the electrical connector comprising:

an insulative base having a plurality of conductive terminals received therein, and defining a bottom surface facing the circuit board, said bottom surface defining a recess;

a cover slidably attached on the base;

a columnar cam actuator disposed on the base and the cover for urging the cover to move relative to the base; and a base plate secured in the recess of the base, the base plate comprising a base portion and an offset portion upwardly offset from the base portion, the offset portion defining a hole therein for inserting of a bottom end of the cam actuator therethrough, the base plate further having an inner receive space therein under the offset portion for accommodating the bottom end of the cam actuator to avoid extending of the bottom end of the cam actuator beyond the bottom surface when the cam actuator is assembled on the base and the cover.

13. The electrical connector as claimed in claim 12, wherein the cam actuator comprises a plurality of columns having different circumferences and offset rotational axis for actuating the cover to slide along the base.

14. The electrical connector as claimed in claim 12, wherein the cover comprises a main housing and a ledge defined at one end of the housing, and a top hole is defined in the ledge and comprises two generally semicircular portions having different diameters from each other.

15. The electrical connector as claimed in claim 12, wherein the recess comprises a lower receiving portion and an upper fastening portion, and the lower receiving portion has a cross-sectional area larger than a cross-sectional area of the upper fastening portion.

16. The electrical connector as claimed in claim 15, wherein a pair of position columns is formed in the base on opposite sides of the receiving portion.

17. The electrical connector as claimed in claim 15, wherein the base portion of the base plate is slightly shorter than a corresponding length of the receiving portion of the recess.

18. The electrical connector as claimed in claim 15, wherein the offset portion of the base plate is completely received in the fastening portion of the recess, and the base portion of the base plate is fittingly received in the receiving portion of the recess.

19. The electrical connector as claimed in claim 16, wherein a pair of position holes is defined in opposite sides of the base portion of the base plate, and the position holes receive the position columns of the base.

20. An electrical connector comprising:

an insulative base defining a step-like downward recess;

an insulative cover slidable upon said base defining a through hole in alignment with recess;

a protection mechanism including a base plate upwardly received in the recess and a cover plate received in the through hole, said base plate defining a periphery region upwardly abutting against the base; and a columnar cam actuator downwardly extending through said cover plate and said base plate; wherein the cover plate is downwardly pressed by a head of the cam actuator, and a central region of said base plate is upwardly pressed by a base ring formed at a bottom end of the cam actuator.

21. The electrical connector as claimed in claim 20, wherein a through hole is defined in said central region for inserting of the bottom end of the cain actuator therethrough, and wherein a receiving space is defined in said base plate below said central region, for receiving the bottom end of the cam actuator therein.

* * * * *